US010273059B2

(12) United States Patent
Vrijens et al.

(10) Patent No.: US 10,273,059 B2
(45) Date of Patent: Apr. 30, 2019

(54) CLOSURE STOPPER FOR PHARMACEUTICAL APPLICATIONS

(75) Inventors: Ronny Prosper Elisabeth Vrijens, Vliermaalroot (BE); Reinhard Louis Jozef Waeben, Hasselt (BE)

(73) Assignee: Datwyler Pharma Packaging International NV, Alken (BE)

( * ) Notice: Subject to any disclaimer, the term of this patent is extended or adjusted under 35 U.S.C. 154(b) by 250 days.

(21) Appl. No.: 13/820,844

(22) PCT Filed: Sep. 1, 2011

(86) PCT No.: PCT/EP2011/065085

§ 371 (c)(1),
(2), (4) Date: Apr. 12, 2013

(87) PCT Pub. No.: WO2012/031969

PCT Pub. Date: Mar. 15, 2012

(65) Prior Publication Data

US 2013/0213924 A1 Aug. 22, 2013

(30) Foreign Application Priority Data

Sep. 9, 2010 (DE) ..... 10 2010 037 438
Jun. 9, 2011 (DE) ..... 10 2011 050 983

(51) Int. Cl.
*B65D 39/00* (2006.01)
*B65D 51/00* (2006.01)
*B65D 51/24* (2006.01)

(52) U.S. Cl.
CPC ..... *B65D 39/0005* (2013.01); *B65D 51/002* (2013.01); *B65D 51/241* (2013.01)

(58) Field of Classification Search
CPC .. B65D 51/00; B65D 51/002; B65D 39/0041; B65D 39/0088

(Continued)

(56) References Cited

U.S. PATENT DOCUMENTS 1,634,655 A * 7/1927 Elston ..... 220/304
2,663,451 A * 12/1953 Yarnall ..... B65D 39/00 220/284

(Continued)

FOREIGN PATENT DOCUMENTS

CA 2 677 408 10/2008
DE 10 2004 034 899 5/2005

(Continued)

OTHER PUBLICATIONS

International Search Report of PCT/EP2011/065085, dated Jan. 24, 2012.

*Primary Examiner* — Ernesto Grano
(74) *Attorney, Agent, or Firm* — Collard & Roe, P.C.

(57) ABSTRACT

A closure stopper for pharmaceutical applications has a sealing flange seating in a sealing manner on an end face of the container's closure mouth. The sealing flange has a lower sealing surface and a boundary plane contacting an area protruding farthest downwardly and extending perpendicularly to the closure stopper's center axis. An engagement portion extending below the sealing flange is formed with a smaller radial extent than the sealing flange. Preferably a handling portion extends above the sealing flange. A circumferential sealing projection also is formed on the engagement portion and protrudes by a radial dimension with respect to an axial portion of the engagement portion initially adjoining the sealing flange from underneath and having a portion-radius. The sealing projection, at least with respect to its base portion, vertically overlaps a set-back region formed on the sealing flange and set back with respect to the contact plane.

21 Claims, 7 Drawing Sheets

(58) Field of Classification Search
USPC ..... 215/355, 247, 276, 277, 249, 329, 307, 215/254
See application file for complete search history.

(56) References Cited

U.S. PATENT DOCUMENTS

| | | | | | |
|---|---|---|---|---|---|
| 2,848,130 | A * | 8/1958 | Jesnig | 215/45 | |
| 2,927,709 | A * | 3/1960 | Hoffman et al. | 215/355 | |
| 3,330,281 | A * | 7/1967 | Visser | 604/90 | |
| 3,578,200 | A * | 5/1971 | Hetzer | B65D 39/0023 138/96 T | |
| 3,695,478 | A | 10/1972 | Sie et al. | | |
| 4,230,231 | A * | 10/1980 | Burnett et al. | 215/329 | |
| 4,545,497 | A | 10/1985 | Martha, Jr. | | |
| 5,314,084 | A | 5/1994 | Folta et al. | | |
| 5,680,953 | A * | 10/1997 | Baughman | 220/288 | |
| 5,862,936 | A * | 1/1999 | Johanson | 220/304 | |
| 6,471,082 | B1 * | 10/2002 | Fritzinger | 220/203.08 | |
| 7,261,216 | B2 * | 8/2007 | Becker et al. | 215/329 | |
| 7,934,613 | B2 * | 5/2011 | Sudo et al. | 215/45 | |
| 7,966,746 | B2 * | 6/2011 | Py | 34/413 | |
| 8,763,831 | B2 * | 7/2014 | Garcia | B65D 39/0023 215/320 | |
| 8,893,907 | B2 * | 11/2014 | Aneas | 215/364 | |
| 2002/0113033 | A1 | 8/2002 | Claessens | | |
| 2009/0001042 | A1 * | 1/2009 | Sever et al. | 215/248 | |
| 2010/0050575 | A1 | 3/2010 | Aneas | | |
| 2010/0089862 | A1 * | 4/2010 | Schmitt | 215/249 | |
| 2010/0206836 | A1 * | 8/2010 | Koshidaka et al. | 215/355 | |

FOREIGN PATENT DOCUMENTS

| | | |
|---|---|---|
| WO | WO 2005/000703 | 1/2005 |
| WO | WO 2008/129144 | 10/2008 |
| WO | WO 2009/002991 | 12/2008 |
| WO | WO 2009/051282 | 4/2009 |
| WO | WO 2011/141376 | 11/2011 |

* cited by examiner

CLOSURE STOPPER FOR PHARMACEUTICAL APPLICATIONS

CROSS REFERENCE TO RELATED APPLICATIONS

This application is the National Stage of PCT/EP2011/065085 filed on Sep. 1, 2011, which claims priority under 35 U.S.C. § 119 of German Application No. 10 2010 037 438.5 filed on Sep. 9, 2010 and German Application No. 10 2011 050 983.6 filed on Jun. 9, 2011, the disclosures of which are incorporated by reference. The international application under PCT article 21(2) was not published in English.

The invention relates to a closure stopper for pharmaceutical applications, in particular for the sealing closure of a container containing a pharmaceutical agent, for example for the closure of an ampoule containing a medicament, having a sealing flange for seating in a sealing manner on an end face of a closure mouth of the container, the sealing flange having a lower sealing surface and a boundary plane which contacts an area protruding farthest downwardly and extends perpendicularly with respect to a center axis of the closure stopper, an engagement portion which extends below the sealing flange and which is formed with a smaller radial extent than the sealing flange, and preferably a handling portion which extends above the sealing flange, a circumferential sealing projection also being formed on the engagement portion and protruding by a radial dimension with respect to an axial portion of the engagement portion initially adjoining the sealing flange from underneath and having a portion-radius.

These types of closure stoppers are already known in various configurations. Reference is made, for example, to WO 2009/002991 A1, WO 2009/051282 A1, US 2010/0050575 A1, WO 2008/129144 A1 (CA 2677408 A1), and WO 2005/000703 A2. The closure stoppers may be made from a variety of materials. In first instance, generally as a base material together with suitable additives, they may be made of natural rubber or rubber material, for example, or also from a comparatively soft plastics material such as a thermoplastic elastomer. However, in a modification of the thermoplastic elastomer, the closure stopper may also be made of a material known from US 2002/0113033 A1, for example. The manufacture of such a closure stopper described in the above-cited publication is also possible within the scope of the present patent application. The closure stoppers may also be covered, at least partially, by a film, in this regard reference being made to DE 10 2004 034 899 A1, for example. The mentioned materials may all be used within the scope of the present patent application. The particulars from the above-cited publications regarding the materials and manufacturing methods described therein are therefore hereby included in full in the disclosure of the present patent application, including for the purpose of incorporating features of the cited patent applications in claims of the present patent application.

These types of closure stoppers are used, among other things, in freeze drying processes. In particular for such freeze drying processes, but also in general, there is a need for advantageously being able to mount the closure stopper with a good sealing action.

These closure stoppers are generally rotationally symmetrical with respect to a center axis.

A closure stopper is known from U.S. Pat. No. 4,545,497 A which, in a one-piece design, provides at the same time a cap. It has an insertion portion and a portion which is outwardly opposite in the closed state and is formed with a outward through cylindrical surface. The outer portion provides a sealing shoulder on the underside. A closure stopper is also known from U.S. Pat. No. 3,695,478 A, which has, in regard to loading of a central piercing cover effected in the closed state, a sealing flange formed to rise outwardly, the flange being pressed downwardly in the closed state. Furthermore, vertical ribs distributed over the periphery are provided on the engagement portion of this closure stopper.

On this basis, it is an object of the invention to provide a closure stopper for pharmaceutical applications which is advantageously formed with regard to mounting the closure stopper on an appropriate container and achieving the closed position.

One possible solution to this object is provided by the subject matter of claim 1, which is based on the fact that the sealing projection, at least with respect to its base portion, vertically overlaps a set-back region which is formed on the sealing flange and is set back with respect to the boundary plane. Thus, there is in question a region which, in relation to the sealing surface, is situated further to the top in the axial direction than the boundary plane. This may be achieved in various ways, for example by a weakening of the flange in this region, or by a configuration of the sealing flange with a forwardly angled cross-section, i.e., a radially outer area whose cross-section protrudes further downwardly than a radially inner area of the sealing flange. In both cases, the surface area portion of the sealing surface that is "active," i.e., actually has a sealing effect, in the closed state is concentrated on an area of the sealing flange situated more radially outwardly. Since in the closed state, the opening cross-section of the mouth of the container, except for a certain compression of the sealing projection that is necessary and desired for achieving the sealing effect, is present anyway in the overlap region facing the sealing projection, an identical configuration of the flange in this region is not necessary.

The object is also met by the subject matter of claim 2, which is based on the fact that a radial extent corresponding to the outer boundary of the radial dimension by which the sealing projection protrudes with respect to an axial portion of the engagement portion situated above the sealing projection, starting from the central axis, corresponds to 1.05 times or more of a smallest portion-radius, and that an axial dimension of the sealing projection, measured along a line parallel to the center line of the closure stopper, corresponds to 0.5 times or more of the difference between the radial dimension and the smallest portion-radius, the parallel line on the top and/or bottom side of the sealing projection forming a tangent with respect to the adjoining area of the axial portion or with respect to an area of a subportion of the engagement portion optionally extending on the bottom side of the sealing projection, in particular at the area, or optionally at both areas, at which, starting from the radially outward side, the tangential contact initially results.

This configuration is characterized by a comparatively widely radially protruding sealing projection and a corresponding receding axial portion with respect to this largest radial dimension of the sealing projection. A comparatively high stress on the sealing projection is thus achieved in the closed state, and therefore, with reference to the sealing projection, a high sealing effect.

It is possible within the scope of the invention that both feature groups described above are implemented in combination in this type of closure stopper.

For a closure stopper described herein, it is also preferred that the sealing effect, in this respect referred to as the overall sealing effect, is achieved axially as well as radially.

An axial sealing effect results with regard to an end face of a mouth, in particular a beaded lip of a vessel closed by the closure stopper. With respect to the sealing projection, also if it possibly acts partially or predominantly as a sliding projection, as described in greater detail below, a sealing effect in the radial direction results inside the mouth.

A downward concave curvature, preferably vertically opposite from the lower set-back region, may also be formed for all closure stoppers on the top side of the sealing flange. Even greater flexibility of the sealing flange is thus achieved. The set-back region is also referred to as a (lower) concave curvature within the scope of the present patent application.

Furthermore, in this regard it is preferred that a cross-sectional line representing a lower surface of the sealing flange, based on a cross-sectional illustration of the closure stopper, has a concave curvature. The lower surface of the sealing flange may coincide with the boundary plane over a fairly large radial area. However, the lower surface of the sealing flange may also coincide with the boundary plane only in a radial area or point, preferably outwardly radial, of the sealing flange, once again based on the cross-sectional illustration in question. As is apparent, the lower surface of the sealing flange is different from the boundary plane, in particular when the boundary plane coincides with the lower surface of the sealing flange only in a radially narrowly delimited area, or even only at certain points, based on a cross-sectional view. The boundary plane in particular does not have to extend at right angles to the center axis, but may extend at right angles thereto.

The mentioned concave curvature results in a weakening of the flange cross-section if (as is possible in principle but not preferred within the scope of the invention) there is not a corresponding convex curvature in the flange cross-section at the top side of this concave curvature. In the configuration which is preferred within the scope of the invention, an advantageous weakening of the sealing flange results in its root portion (radially innermost portion). An elastic deformation in this region in the closed state makes it possible to ensure a certain prestressing in the closed state due to a sealing contact.

This desired weakening may be supplemented and increased by the above-mentioned circumferential recess in the sealing flange on the top side, i.e., a concave curvature at the top.

It is further preferred that the concave curvature is formed at a transition of the sealing flange into the engagement portion. Thus, the concave curvature is formed close to the center, near the central region of the closure stopper.

The cross-sectional line, which represents the boundary line of the concave curvature in the cross-section, is formed in the region of the concave curvature, to extend, at least in part, in a circular segment shape. Good tear resistance, and at the same time formation of the concave curvature to the desired degree, are thus achieved.

The cross-sectional line may also extend, at least in part, at right angles to the center line in the region of the concave curvature, for example in a case in which the concave curvature is formed in a groove-like manner, in a manner of speaking, with a groove base extending in a straight line. However, the groove base may also extend at an angle in the cross-section, in which case a partial portion of the cross-sectional line extends at an acute angle with respect to the center axis. Similarly, the cross-sectional line may also have a portion that extends in a straight line, i.e., at right angles to another portion. The portion which extends at an acute angle with respect to the center axis may be angled upward or downward.

Furthermore, it may be provided that the concave curvature merges in an axially downward direction directly into the smallest portion-diameter of the engagement portion. However, in the closed state, this engagement portion does not necessarily have to be situated beneath a mouth plane. The basic point being addressed is merely that the engagement portion extends below the flange formation.

The mentioned concave curvature is also a set-back region, as described below. However, within the scope of the invention, such a set-back region is referred to as a concave curvature, which results as a deviation from the cross-sectional line.

It is also preferred that two or more sealing projections are formed on the engagement portion at an axial distance from one another. The result in particular is that the sealing effect may be concentrated on two or more sealing projections.

Additionally or alternatively, one sealing projection, or two or more, or the two or more sealing projections, may also additionally or alternatively act as a sliding projection, as described in greater detail below.

In such a configuration it is further preferred that in any case two sealing projections have different radial dimensions. This means that one sealing projection may be inserted more easily than the other sealing projection.

In that case, it is further preferred that an upper sealing projection, viewed from the sealing flange, has a greater radial dimension than a lower sealing projection. Thus, the closure stopper may be initially driven into the opening in the container into a first position comparatively easily, and then, with respect to the second sealing projection, may be inserted with somewhat greater force.

With regard to the configuration of the sealing stopper, it is further preferred that a central recess is formed in the region of the insertion portion. The recess may have a cylindrical wall portion in the region of the sealing projection, or optionally at least in the region of a first sealing projection. In addition, the recess may have a wall portion which widens radially outwardly in the region of the sealing projection, at least in the region of an optionally provided second sealing projection.

It is also preferred that the insertion portion has a widening outer contour beneath the optional first sealing projection. A tilting tendency, for example, may thus be advantageously counteracted.

The subject matter of the invention also pertains to a closure for a container, for example an ampoule, in which a medicament is preferably accommodated, which has a closure cap and a closure stopper, having a sealing flange, accommodated in the closure, detent moldings being formed on the closure cap for the detent mounting of the closure on the ampoule.

These types of closures are widely known. In addition to the publications mentioned at the outset, in this regard reference is also made to U.S. Pat. No. 5,314,084 A.

In the known closures, the closure caps of the closures are initially situated on the container in a first position in which drying of the medicament accommodated in the container may be carried out via airways provided into the interior of the container, for example in a freeze drying chamber. After completion of the freeze drying, the closure caps are brought into a second position in which they are locked to a mouth edge of the container, and in which a sealing flange of the closure stopper accommodated in the closure cap is seated on an end-face-side mouth surface of the container in a sealing manner.

In this regard, a technical object of the invention is to achieve the most durable and secure seal possible.

This technical object is achieved by the subject matter according to claim 16, according to which the radially outwardly downwardly sloping sealing flange in the closed position is raised by interaction with a mouth edge of the container. The unaffected closure stopper, which in particular is not yet in a sealing closed position, correspondingly has a design of the sealing flange which is angled in the direction of mounting onto the container, toward the front. In a departure from an angled shape which is continuous (in cross-section), beginning at a central region, the mentioned divergence may also be achieved, for example, by a radially outward circumferential shoulder on the underside of the sealing flange.

A closure stopper mounted in this way on the container has a corresponding continuous elastic prestressing into the sealed position. Deflection is different, depending on the extent of inclination of the sealing flange in the radially outward direction. For a greatly angled design, the deflection is correspondingly greatest in the radially outward direction, and decreases toward the center. In addition to the effect of the continuous elastic prestressing in the sealed position, in such a closure stopper there is also an intensified sealing effect for the sealing projection which engages with the containers. The sealing projection is (further) pretensioned into its sealed position by the mentioned deformation.

The closure may in particular have a two-part design. It is further preferred that the closure has a sliding part which may be displaced relative to a stationary closure cap from an open position, in which freeze drying, for example, may be carried out, into a closed position.

In the closed position, the sliding part is movable downwardly relative to the closure cap. It is particularly preferred that in the closed position, the sliding part locks relative to the closure cap.

The invention is explained in greater detail below with reference to the appended drawings, which, however, merely represent exemplary embodiments. The drawings show the following:

Closure stoppers 1 are illustrated and described which are used for closing containers in which pharmaceutical agents, in particular medicaments, are contained. The closure stoppers are used for the sealing closure of such a container, for example an ampoule. In particular, the illustrated and described closure stoppers 1 may also be used in a closure that is suitable for carrying out a freeze drying process.

Figure 1:
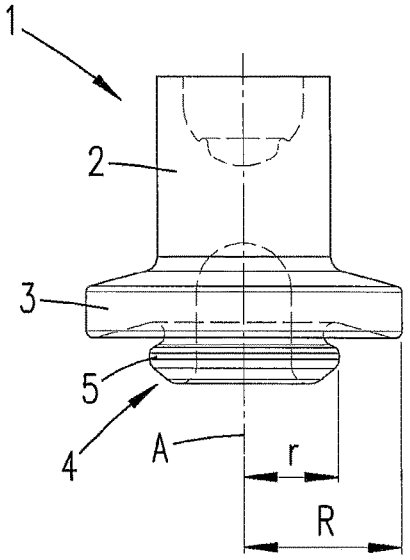
FIG. 1 shows a side view of a closure stopper in a first embodiment.
Figure 2:
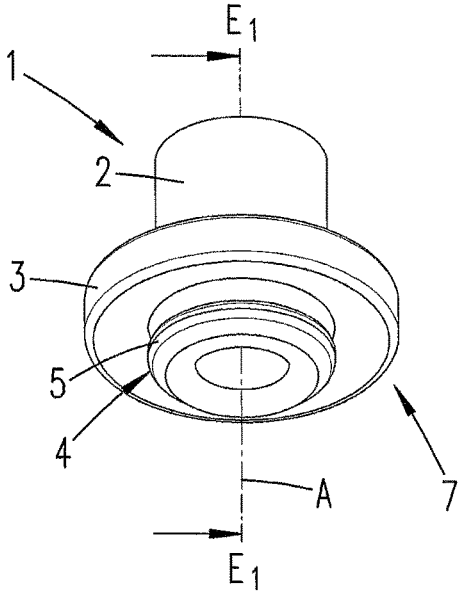
FIG. 2 shows an illustration corresponding to FIG. 1, in an oblique perspective view from below.
Figure 3:
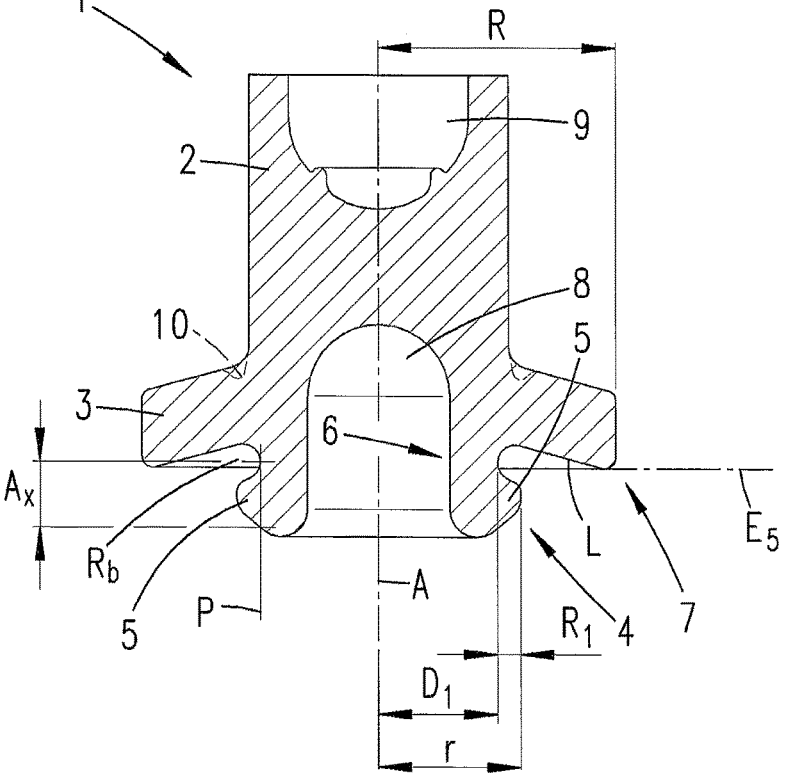
FIG. 3 shows a cross-section of the subject matter according to FIG. 1 and FIG. 2, sectioned in the plane E1-E1 in FIG. 2.

The closure stopper 1, with initial reference in particular to the embodiment in FIGS. 1 to 3, has in particular a handling portion 2, which preferably and in the exemplary embodiment is formed as a cylindrical body. In addition, a sealing flange 3, which begins at the lower end of the handling portion 2, is provided. Furthermore, an engagement portion 4 which extends beneath the sealing flange 3, is provided.

The closure stopper 1 has a center axis A. In the exemplary embodiment and also preferably, the closure stopper 1 is formed rotationally symmetrically with respect to the center axis A.

The engagement portion 4 has a smaller radial extent r, starting from the center axis A, than the sealing flange 3, which has a radial extent R. This applies to the largest radial extent r of the engagement portion 4.

A circumferential sealing projection 5 is provided on the engagement portion 4, and forms part of same. As is apparent in particular from FIG. 3, for example, the sealing projection 5 is formed to be radially protruding with respect to an axial portion 6 which initially adjoins the closure stopper 1 beneath the sealing flange 3. The sealing projection protrudes by a radial dimension R1, which radially outwardly adjoins the smallest portion-radius D1, relative to an outer surface of the engagement portion 4 (in the present case, R1 corresponds to the difference between r and D1).

The sealing projection 5 as well as a sealing flange 3 may be angled in a downward direction. Such an angled shape is present in particular when a lower boundary line of the sealing projection 5 and/or of the sealing flange 3, based on a cross-sectional illustration, extends, at least over a subportion, in an upwardly sloping manner from the outside to the inside. In particular with respect to a sealing projection 5, an angled shape may also be provided by a lower boundary line which slopes downwardly from the outside to the inside. It is preferred that an upper boundary line also extends at least over a corresponding portion parallel or at least also in an upwardly or downwardly sloping manner (from the outside to the inside). In particular with respect to the sealing projection 5, the upper and lower boundary lines may also extend in opposite directions, for example with the lower boundary line sloping downwardly from the outside to the inside, and at the same time the outer boundary line sloping upwardly from the outside to the inside. This results in a wedge-shaped configuration in the cross-section.

As is also apparent from the cross-sectional illustrations in FIGS. 3, 5, 7, 9, and 11, for example, the angled as well as the non-angled sealing flange 3 and/or the angled or non-angled sealing projection 5 preferably has/have a boundary edge which extends vertically relative to the illustration. Sometimes, in particular if a punched-out portion is involved, the boundary edge may generally extend vertically, but in a detailed view, also nonuniformly, for example with slightly curved portions.

The sealing flange 3 has a contact plane E5 on the bottom side. The contact plane E5 extends at right angles to the center axis A, and is defined by the plane that is first in contact with the sealing flange 3 upon an imaginary approach to the sealing flange from below. As is apparent, in the exemplary embodiment in FIGS. 1 to 3 the contact is effected in a radially outer area 7 of the sealing flange 3. A set-back region $R_b$ is formed on the sealing flange 3, above the contact plane E5. In the set-back region $R_b$, the contour line L on the underside of the sealing flange 3 diverges upwardly with respect to the contact plane E5.

In the exemplary embodiment and also preferably, the mentioned diameter D1 results within the set-back region $R_b$ or in the vertical projection with respect to the set-back region $R_b$.

In the exemplary embodiments in FIGS. 1 to 3 and 8 to 11, the sealing projection 5 completely overlaps the set-back region $R_b$ i.e., in the vertical projection viewed from below.

A radial extent r corresponding to the outer boundary of the radial dimension R1 corresponds to 1.05 times or more, up to 2 times, for example, the smallest portion-radius D1.

In addition, the sealing projection 5 has an axial dimension Ax. The axial dimension Ax is measured along a line P parallel to the center axis A of the closure stopper 1. The parallel line P extends at a radial distance from the center axis A at which, starting from the outside, the parallel line for the first time forms a tangent with respect to the axial area of the engagement portion adjoining the sealing projection 5. The contact of the tangent may be on the bottom side, the top side, or the bottom and top sides of the sealing projection 5. In the embodiment in FIGS. 1 to 3, it is apparent that this contact is on the top side of the sealing projection 5. In the embodiment in FIGS. 1 to 3, the parallel line P coincides with the boundary line of the portion-radius D1.

The intersection points or contact points (in the case of the tangent), or an intersection point and a contact point, of the contour line of the sealing projection 5 with the parallel line P, measured on the parallel line P in the vertical direction, result in the mentioned axial dimension Ax. This axial dimension Ax corresponds to 0.5 times or more of the difference between the radial dimension r and the portion-radius D1. In the exemplary embodiment, this value is approximately a factor of 2, and may correspond to up to a factor of 4, for example. With regard to the drawing illustration in FIG. 3, the difference between the radial dimension r (22 mm) and the portion-radius D1 (18 mm) is 4 mm, for example, so that the axial dimension Ax, which is readable at 10 mm from the drawing, corresponds to greater than 0.5 times the difference between r and D1 (2 mm). The axial dimension Ax may correspond to a value that is up to four times the mentioned difference. In the exemplary embodiment, this would apply up to an extent of 16 mm. For purposes of simple explanation, the dimensions ascertainable directly from the drawing have been used here. In fact, however, such a closure stopper may generally be smaller than illustrated. The actual dimensions therefore correspond, for example, to one-fourth to one-eighth of the dimensions that are ascertainable from the drawing.

In the exemplary embodiment in FIGS. 4 and 5, a second projection 21, referred to here as a sliding projection, is further provided below the sealing projection 5. When the closure stopper 1 is inserted into an appropriate container, the sliding projection may be used to push back liquid, i.e., direct it into the central region of the closure stopper 1. The projections 5 and 21 are spaced apart axially. The sliding projection is therefore preferably formed in the sense of a radially outward wiping lip with respect to an interaction with an inner surface of the mouth of a vessel in which the sliding projection is to be inserted.

Identical or analogous reference numerals (for example, D1, E2, etc.) in all embodiments denote the same elements, to which the above statements in this regard then also basically apply.

A distance Z between the projections 5 and 21 in the direction of the center axis A preferably corresponds to approximately one-twentieth to 1 times the portion-radius D1. In the exemplary embodiment in FIGS. 4 and 5, the dimension Z corresponds to approximately 0.72 times the portion-radius D1. It is apparent that the dimension Z at the intersection points of horizontals through the projections 5, 21 is taken at the radially outermost points of the projections, based on the cross-sectional illustration. In this regard, if there is no radially outermost point, but, rather, a radially outermost line, for example, the dimension Z in each case should be taken from the center of a vertical extent of this radially outermost line, which in that case is correspondingly a vertical.

It is also apparent that, as is also preferred, the radial dimensions R1 and R2 are different. In addition, the axial dimensions Ax1 and Ax2 are different. The radial dimension R2 of the lower projection 21 is preferably smaller than the radial dimension R1 of the upper sealing projection 5. It is also preferred that the dimension r is determined by the upper sealing projection 5. It is further preferred that the axial dimension Ax2 is smaller than the axial dimension Ax1.

These mentioned differences are also preferably significant, at any event in the range of 1 to 20%.

Figure 6:
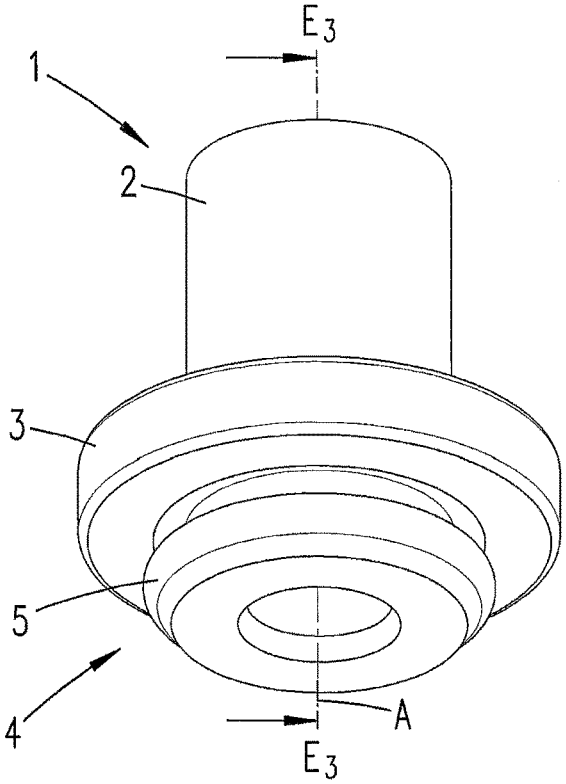
FIG. 6 shows an illustration corresponding to FIG. 2 of subject matter of a third embodiment.
Figure 7:
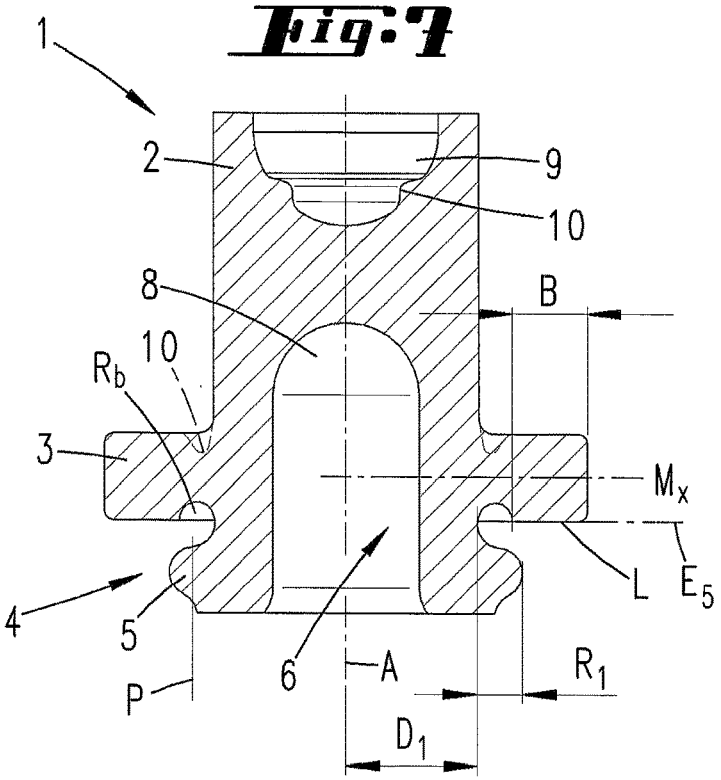
FIG. 7 shows a cross-section of the subject matter according to FIG. 6, sectioned along a plane E3-E3 in FIG. 6.

In the exemplary embodiment in FIGS. 6 and 7, the set-back region $R_b$ in the contour line L is formed by a circular segment shape. In addition, the sealing flange 3, which as a whole extends at right angles to the center axis A relative to a center axis MX, has a portion B which is formed without a set-back region $R_b$. The portion B is formed radially outside the set-back region $R_b$. The portion B has a length that preferably corresponds to one-half to up to 4 times the dimension R1.

The sealing projection 5 with respect to its radial dimension R1 radially exceeds a corresponding dimension of the set-back region $R_b$.

Figure 8:
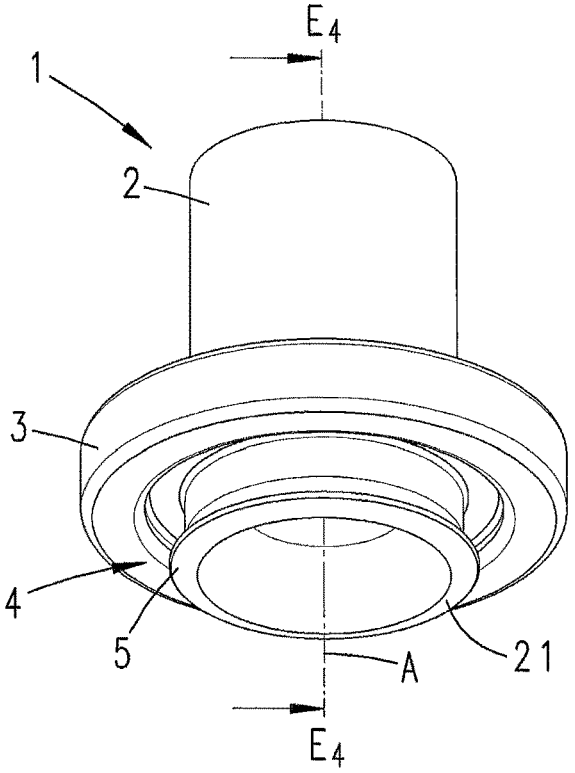
FIG. 8 shows an illustration corresponding to FIG. 2 in a fourth embodiment.
Figure 9:
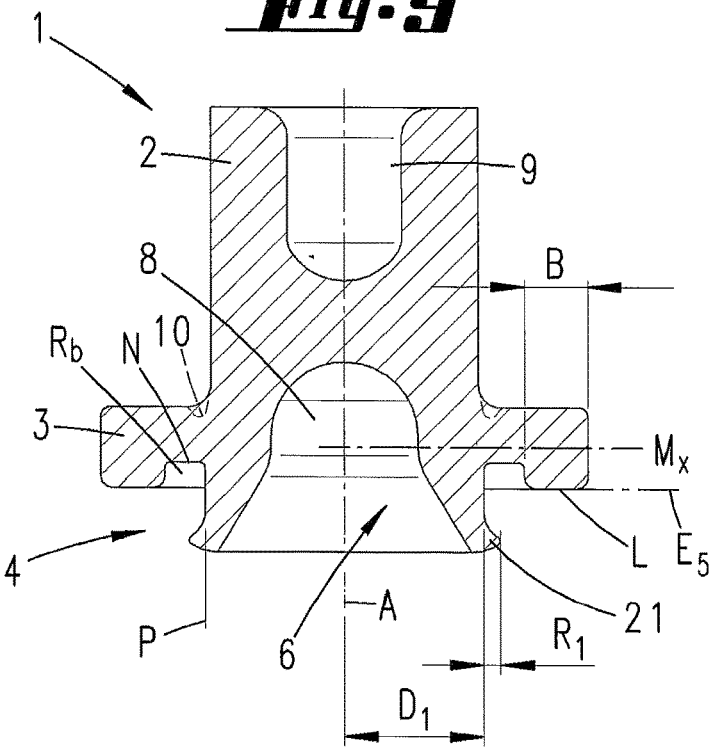
FIG. 9 shows a cross-sectional illustration of the subject matter according to FIG. 8, sectioned along the plane E4-E4 in FIG. 8.

In the exemplary embodiment in FIGS. 8 and 9, the configuration of the set-back region $R_b$ is basically comparable to the embodiment in FIGS. 6 and 7. In the present case, however, the groove base N of the set-back region $R_b$ is formed as a straight line with regard to the contour line L, and in the exemplary embodiment is in the form of a straight line which also extends at right angles to the center axis A. In the present case, the sealing projection 5 is provided only in the form of a sliding projection 21. The sliding projection 21 as described within the scope of the present patent application does not have to be provided in addition to a sealing projection 5; it may also be provided alone, or instead of, a sealing projection 5.

A set-back region $R_b$ which results from a deviation of the contour line L from a straight line (see the embodiments in FIGS. 6 to 9) is also referred to as a (lower) concave curvature within the scope of the present patent application.

In the present exemplary embodiment, the maximum radial extent of the recess $R_b$ (once again) exceeds the dimension D1 plus dimension R1.

Figure 4:
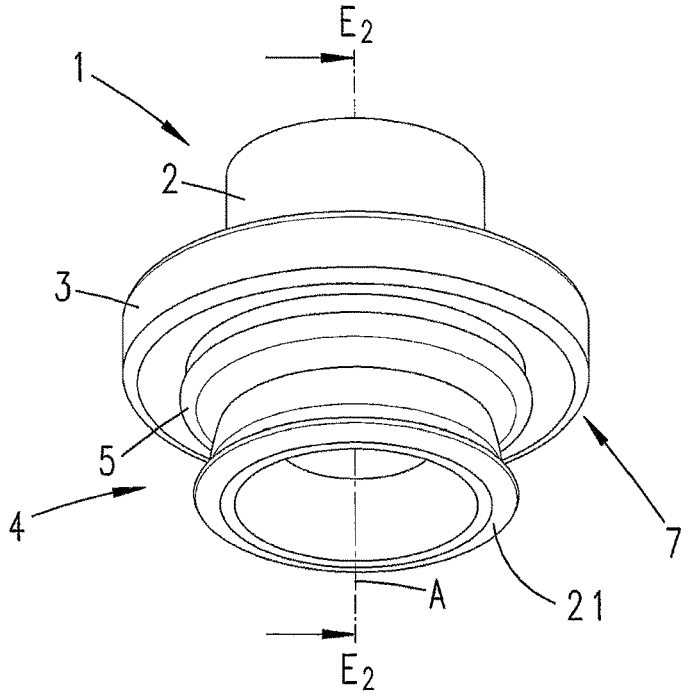
FIG. 4 shows an illustration corresponding to FIG. 2 in a second embodiment.
Figure 5:
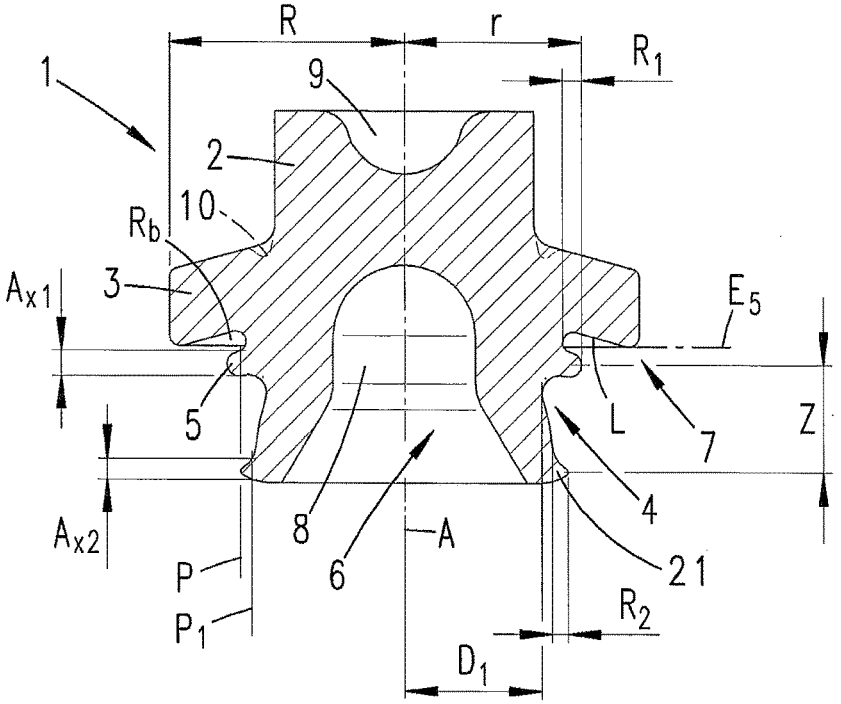
FIG. 5 shows a cross-section of the subject matter according to FIG. 4, sectioned along a plane E2-E2 in FIG. 4.

In the exemplary embodiment in FIGS. 10 and 11, once again two projections 5, 21 are formed one beneath the other in the axial direction, corresponding approximately to the embodiment in FIGS. 4 and 5, except that the axial distance Z is much smaller. In addition, the difference between the largest radial extent dimension R and the dimension D1 plus R1 is greater.

The respective characteristics of the individual embodiments are not just important with regard to the particular embodiment. Thus, the magnitude of the axial dimension Ax in the embodiments in FIGS. 1 to 3 may be provided in a comparable magnitude for the sealing projections 5 in the embodiments [in FIGS.] 4, 5 or 8, 9. The configuration of the region $R_b$ according to the embodiment in FIG. 6 may also be provided for the embodiment in FIG. 1 to 3, 4, 5, 8, 9, or 10, 11. Conversely, the configuration of the region $R_b$ according to the embodiment in FIGS. 6, 7 may also be provided for the embodiment in FIG. 1 to 3, 4, 5, 8, 9 or 10, 11. Similarly, the linearly extending configuration of the sealing flange 3, as basically known from the embodiments in FIG. 6, 7 or 8, 9, may also be implemented in the embodiments in FIG. 1 to 3, 4, 5 or 10, 11.

In the event that two projections 5, 21 are implemented, one or both of the projections, as described above in particular with regard to the sealing projection 5, may also be formed with an angled shape in the downward direction.

As a result of forming the sealing flange 3 on the one hand and a sealing projection 5, the latter optionally also in the form of a sliding projection 21, on the other hand, in the closed state, an overall sealing effect is achieved which results from the sum of an axial sealing effect (by the sealing flange 3) and a radial sealing effect (by the sealing projection 5 or optionally also a plurality of same, and/or a sliding projection 21).

All of the illustrated closure stoppers are rotationally symmetrical with respect to the center axis A.

With regard to the disclosure, the various above-stated ranges of relative or percent dimensions also include all values in between, in particular in one-tenth increments, specifically, in one-tenth percent increments, i.e., on the one hand for delimitation of the stated range limits from below and/or from above, but also, alternatively or additionally, with regard to the disclosure of one or more single values from the particular range.

Furthermore, it is noted that for all embodiments it is apparent that the closure stopper has a central first cavity 8 extending from its lower end and/or a further central cavity 9 extending from its upper end.

The cavity 8 and/or the cavity 9 may initially have a cylindrical shape in its/their starting region, and adjacent thereto may have a contour line with a curved terminating shape, for example in the form of a circular line.

It is also preferred that the cavity 8, starting from below, extends into the region of the sealing flange 3, and particularly preferably also extends farther upwardly.

Figure 10:
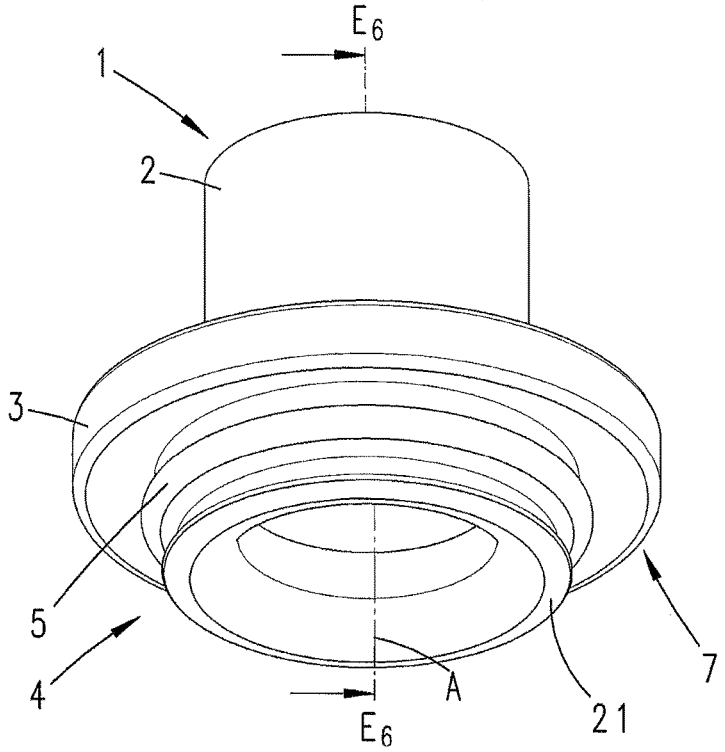
FIG. 10 shows an illustration corresponding to FIG. 2 in a fifth embodiment.
Figure 11:
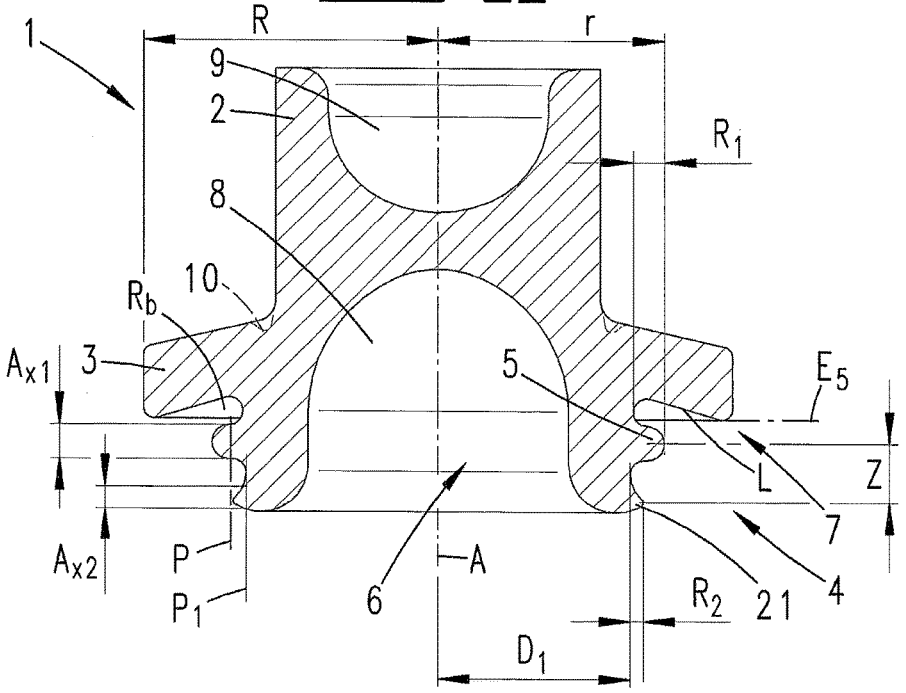
FIG. 11 shows a cross-sectional illustration of the subject matter according to FIG. 10, sectioned along the plane E6-E6 in FIG. 10.

As shown in the embodiment in FIGS. 8 and 9 and, even though less pronounced, in the embodiment in FIGS. 10 and 11, at the start, the cavity 8 and/or 9 may also have a conically tapering portion. Overall, this results in a cross-sectional line corresponding to a bell shape.

The mentioned cavity shapes in each case are once again not limited to one of the mentioned embodiments. The fact that the cavity shapes are specifically illustrated in combination in only one embodiment in each case is strictly by way of example. The cavity shapes may be provided in a similar manner in the other embodiments as well.

Figure 12:
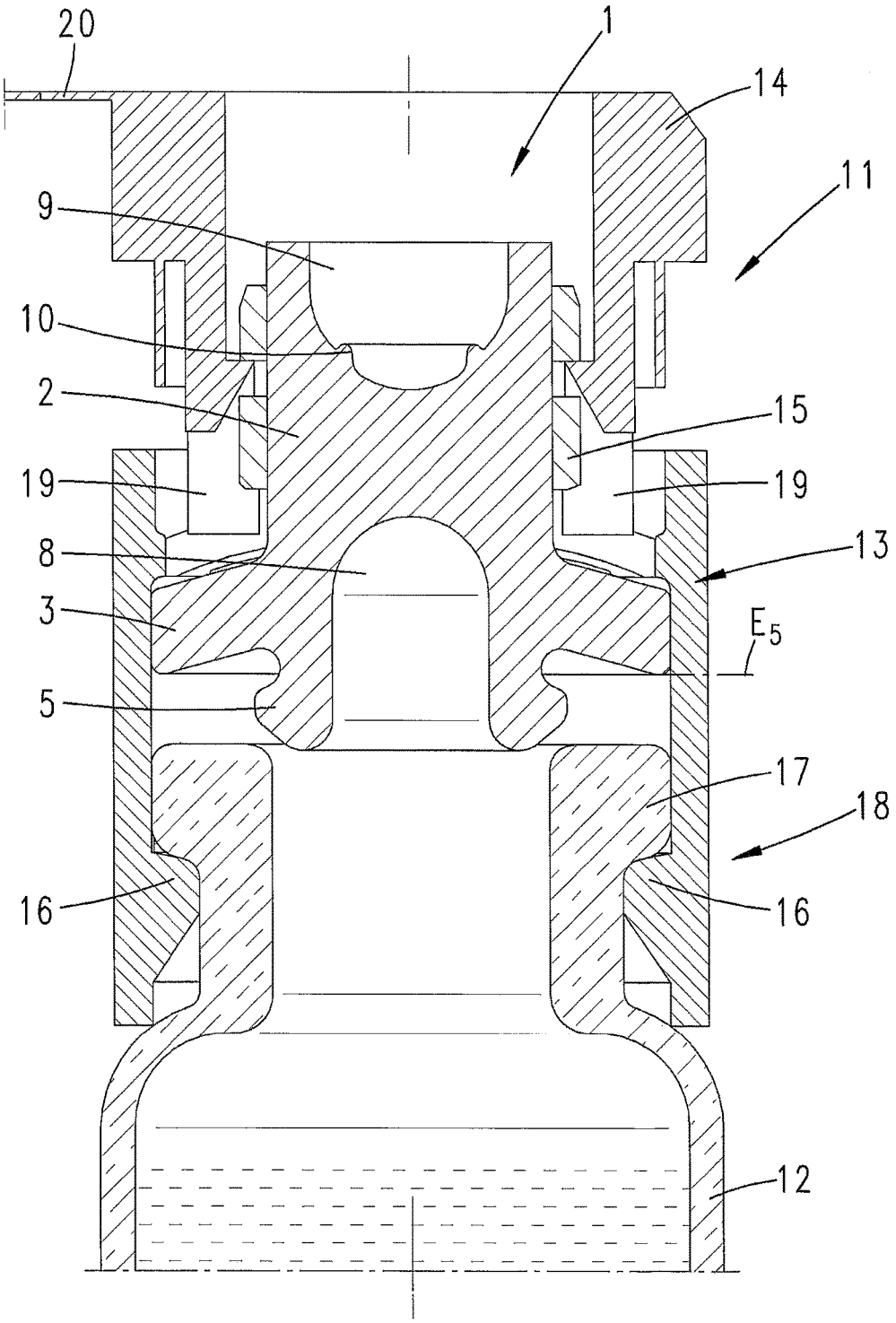
FIG. 12 shows a cross-sectional illustration of an insertion of a closure stopper in the embodiment in FIGS. 1 to 3 in a closure used for freeze drying, in the open state.
Figure 13:
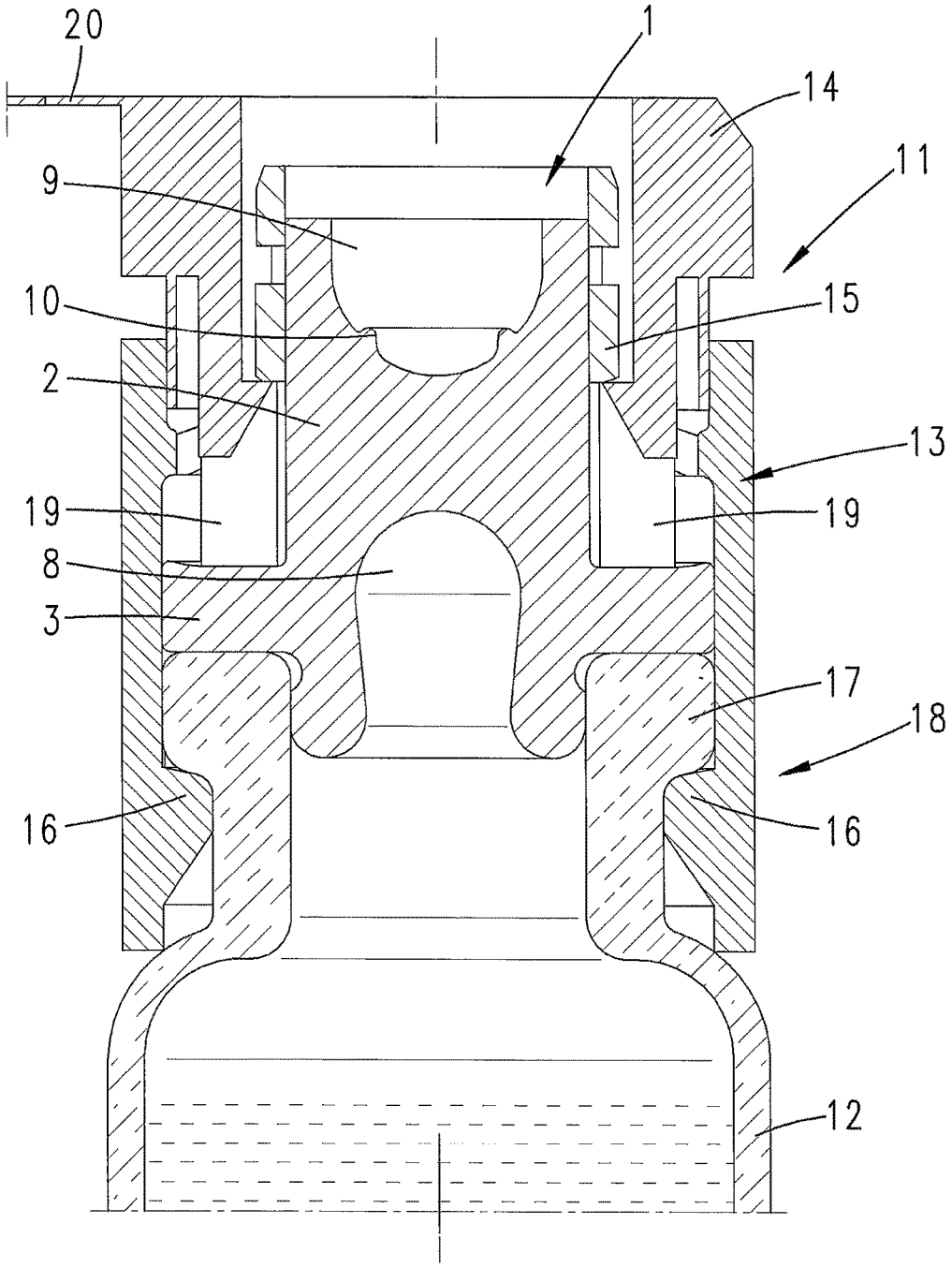
FIG. 13 shows an illustration according to FIG. 12, in the closed state.

With reference to FIGS. 12 and 13, the application for a freeze drying closure is illustrated.

This is a closure 11 that is mounted on a medical ampoule 12. A medicament, preferably initially in liquid form, is present in the ampoule 12. It is further preferred that this medicament is subsequently converted to powdered form by the freeze drying.

In particular, the closure 11 is composed of a closure cap 13 and a sliding part 14, which in the exemplary embodiment is to be partially protruding from the top with respect to the closure cap 13. In the exemplary embodiment, a lid, not illustrated in greater detail here, is also preferably connected as one piece to the sliding part 14 via a connection 20.

As is further apparent from the cross-sectional illustrations in FIGS. 12 and 13, the closure stopper 1 is accommodated inside the closure cap 13 and the sliding part 14. With regard to a possible sliding guide, the handling portion 2 is accommodated in an annular part 15 of the closure cap 13 which results in a corresponding enclosure for the handling portion 2. The annular part 15 is correspondingly formed on the closure cap 13, but also centrally with respect to a center axis, with a smaller radius dimension than an outer wall of the closure cap 13.

The closure cap 13 also has detent moldings 16 by means of which the closure cap engages beneath a beaded lip 17 of the ampoule 12 in the locked state.

The detent moldings 16 are formed on elastically bendable detent feet 18 which are correspondingly able to elastically rebound outwardly when the closure cap 13 is put onto the ampoule 12, and are thus able to travel past the mentioned lip 17 of the ampoule 12.

As is further apparent from a comparison of FIGS. 12 and 13, the closure stopper 1 is displaced relative to the closure cap 13 from an open position according to FIG. 12, in which freeze drying may be carried out, into a closed position according to FIG. 13, by means of the sliding part 14, specifically, by means of mounting feet 19 formed thereon. In the closed position, the sliding part 14 is moved downwardly relative to the closure cap 13. Due to the resulting elastic deformations, the sealing flange 3 of the closure stopper 1 lies practically flat on the corresponding end face of the beaded lip 17 of the ampoule 12, and the sealing projection 5 is deformed in such a way that at any event, a uniform outer periphery of the insertion portion results in the illustration. The insertion portion is cylindrically formed over a significant part of its height due to deformation and compression. In addition, a certain undercut which corresponds to the dimension D1 may remain (see above).

In FIGS. 3, 5, 7, 9, and 11, it is also indicated in each case by the reference numeral 10 that a circumferential recess 10 may also be provided on the top side of the sealing flange 3 which preferably, but not necessarily, is provided vertically opposite from the set-back region $R_b$ on the underside of the sealing flange 3. It is further preferred that an inner boundary line of such a recess 10 merges into the cylindrical surface of the handling portion 2.

| List of reference numerals | |
|---|---|
| 1 | Closure stopper |
| 2 | Handling portion |
| 3 | Sealing flange |
| 4 | Engagement portion |
| 5 | Sealing projection |
| 6 | Axial portion |
| 7 | Area |
| 8 | Cavity |
| 9 | Cavity |
| 10 | Concave curvature |
| 11 | Closure |

-continued

| List of reference numerals | |
|---|---|
| 12 | Ampoule |
| 13 | Closure cap |
| 14 | Sliding part |
| 15 | Annular part |
| 16 | Detent moldings |
| 17 | Beaded lip |
| 18 | Detent feet |
| 19 | Mounting feet |
| 20 | Connection |
| 21 | Sealing projection or sliding projection |
| E1-4 | Plane |
| E5 | Boundary plane |
| E6 | Plane |
| D1 | Portion-radius |
| R1 | Radial dimension |
| R2 | Radial dimension |
| $R_b$ | Set-back region |
| Ax | Axial dimension |
| P | Parallel line |
| A | Center line |
| L | Cross-sectional line |
| Z | Distance |
| R | Extent dimension |
| B | Portion |
| r | Radial dimension |

The invention claimed is:

1. A closure stopper (1) for pharmaceutical applications, namely the sealing closure of a container containing a pharmaceutical agent, having a sealing flange (3) for seating in a sealing manner on an end face of a closure mouth of the container, the sealing flange (3) having a lower sealing surface and a boundary plane (E5) which contacts an area protruding farthest downwardly of the sealing flange, and said contact is indeed a farthest downwardly area of the sealing flange, and extends perpendicularly with respect to a center axis of the closure stopper (1), an engagement portion (4) which extends below the sealing flange (3) and which is formed with a smaller radial extent than the sealing flange (3), and a handling portion (2) which extends above the sealing flange (3), a circumferential sealing projection (5) also being formed on the engagement portion (4) and protruding by a radial dimension (R1) with respect to an axial portion of the engagement portion (4) initially adjoining the sealing flange (3) from underneath and having a portion-radius (D1), wherein the circumferential sealing projection (5), at least with respect to its base portion, vertically overlaps a set-back region ($R_b$) which is formed on the sealing flange and is set back with respect to the boundary plane (E5), and wherein said set-back region ($R_b$) is an indented structure in the lower flange surface;

wherein material from which the closure stopper is made comprises at least one of a natural rubber, a rubber material, a soft plastics material, and a thermoplastic elastomer; and wherein said sealing flange (3) is elastically deformable; and wherein the circumferential sealing projection (5) is elastically deformable such that the sealing flange (3) of the closure stopper lies flat on the corresponding end face on a beaded lip of an ampoule in a combined state; and wherein the closure stopper (1) has a central recess (8) in the region of the engagement portion (4), and said central recess (8) is starting from the lower most end of the engagement portion (4) and, wherein the central recess (8) has a cylindrical wall portion in the region of the circumferential sealing projection (5); and wherein the closure stopper is formed rotationally symmetrically with respect to the center axis;

wherein the circumferential sealing projection is extending circumferentially without interruption in a plane perpendicular to the center axis; and wherein a lower surface of the sealing flange (3) coincides with the boundary plane (E5) only in an outer radial portion of the sealing flange (3), and wherein a cross-sectional line (L) defines an acute angle with respect to a center line (A) and additionally, wherein an upper surface of the sealing flange (3), in a section view, runs also in an acute angle with the center line (A), which upper surface in this section view runs in such an angle wherein the upper surface and the cross-sectional line run in the same sense of declining with greater radius.

2. The closure stopper according to claim 1, wherein a radial extent (r) corresponding to the radial dimension (R1) corresponds to 1.05 times or more of a smallest radius (D1) of the engagement portion (4), and wherein an axial dimension (Ax), measured along a line (P) parallel to a center line (A) of the closure stopper (1), corresponds to 0.5 times or more of the difference between the radial dimension (R1) and the smallest radius (D1), the parallel line (P) on the top and/or bottom side of the circumferential sealing projection (5) forming a tangent with respect to the adjoining area of the axial portion or with respect to an area of a subportion of the engagement portion (4).

3. The closure stopper according to claim 1, wherein the sealing flange is beginning at the lower end of the handling portion (2).

4. The closure stopper according to claim 1, wherein the cross-sectional line (L) with respect to a cross-sectional illustration of the closure stopper, representing the lower surface of the sealing flange (3), runs according to a concave curvature ($R_b$).

5. The closure stopper according to claim 4, wherein the concave curvature ($R_b$) extends, at least in part, in a circular segment shape.

6. The closure stopper according to claim 4, wherein the cross-sectional line (L) extends, at least in part, at right angles to the center line (A) in the region of the concave curvature ($R_b$).

7. The closure stopper according to claim 4, wherein the concave curvature ($R_b$) merges directly into the portion having the smallest radius (D1).

8. The closure stopper according to claim 1, wherein a lower projection (21) is formed on the engagement portion (4) at an axial distance beneath the circumferential sealing projection (5).

9. The closure stopper according to claim 8, wherein the circumferential sealing projection (5) and the lower projection (21) have different radial dimensions (R1, R2).

10. The closure stopper according to claim 8, wherein the circumferential sealing projection (5), viewed from the sealing flange (3), has a larger radial dimension (R1) than the lower projection (21), having a radial dimension (R2).

11. The closure stopper according to claim 1, wherein a sealing effect is achievable with regard to an end-face seal of a vessel which is closable by the closure stopper, and, with regard to an overall sealing effect, also at least in part in the radial direction.

12. The closure stopper according to claim 1, wherein the central recess (8) has a radially outwardly widening wall portion in the region of the circumferential sealing projection (5), at least in the region of the lower projection (21).

13. The closure stopper according to claim 1, wherein the central recess (8) extends upwardly until the region of the sealing flange (3) that the handling portion (2) has a further cavity (9), starting from an upper free end of the handling portion (2), and that the circumferential sealing projection (5) has a greater radial extension than the set-back region ($R_b$) combined with a lower straight boundary line of the flange.

14. A closure stopper (1) for pharmaceutical applications, namely the sealing closure of a container containing a pharmaceutical agent, having a sealing flange (3) for seating in a sealing manner on an end face of a closure mouth of the container, the sealing flange (3) having a lower sealing surface and a boundary plane (E5) which contacts an area protruding farthest downwardly of the sealing flange, and said contact is indeed a farthest downwardly area of the sealing flange, and extends perpendicularly with respect to a center axis of the closure stopper (1), an engagement portion (4) which extends below the sealing flange (3) and which is formed with a smaller radial extent than the sealing flange (3), and a handling portion (2) which extends above the sealing flange (3), a circumferential sealing projection (5) also being formed on the engagement portion (4) and protruding by a radial dimension (R1) with respect to an axial portion of the engagement portion (4) initially adjoining the sealing flange (3) from underneath and having a smallest radius (D1), wherein the circumferential sealing projection (5), at least with respect to its base portion, vertically overlaps a set-back region ($R_b$) which is formed on the sealing flange and is set back with respect to the boundary plane (E5), and wherein said set-back region ($R_b$) is given by an oblique extension, concerning a cross section, of a lower surface of the sealing flange;

wherein material from which the closure stopper is made comprises at least one of a natural rubber, a rubber material, a soft plastics material, and a thermoplastic elastomer; and wherein said sealing flange (3) is elastically deformable; and wherein the circumferential sealing projection (5) is elastically deformable such that the sealing flange (3) of the closure stopper lies flat on the corresponding end face on a beaded lip of an ampoule in a combined state; and wherein the closure stopper (1) has a central recess (8) in the region of the engagement portion (4), and said central recess (8) is starting from the lower most end of the engagement portion (4) and, wherein the central recess (8) has a cylindrical wall portion in the region of the circumferential sealing projection (5); and wherein the closure stopper is formed rotationally symmetrically with respect to the center axis;

wherein the circumferential sealing projection is extending circumferentially without interruption in a plane perpendicular to the center axis; and wherein a lower surface of the sealing flange (3) viewed in a cross-section coincides with the boundary plane (E5) only in an outer radial portion of the sealing flange (3) and wherein a cross-sectional line (L) defines an acute angle with respect to a center line (A) and additionally, that an upper surface of the sealing flange (3), in a section view, runs also in an acute angle with the center line (A), which upper surface in this section view runs in such an angle wherein the upper surface and the cross-sectional line run in the same sense of declining with greater radius.

15. The closure stopper according to claim 14, wherein the central recess (8) extends upwardly until the region of the sealing flange (3) that the handling portion (2) has a further cavity (9), starting from an upper free end of the handling portion (2) and that the circumferential sealing projection (5) has a greater radial extension than the set-back region ($R_b$) combined with a lower straight boundary line of the flange.

16. The closure stopper according to claim 14, wherein there is a widening contour being below the circumferential sealing projection (5).

17. A closure stopper (1) for pharmaceutical applications, namely the sealing closure of a container containing a pharmaceutical agent, having a sealing flange (3) for seating in a sealing manner on an end face of a closure mouth of the container, the sealing flange (3) having a lower sealing surface and a boundary plane (E5) which contacts an area protruding farthest downwardly of the sealing flange, and said contact is indeed a farthest downwardly area of the sealing flange, and extends perpendicularly with respect to a center axis of the closure stopper (1), an engagement portion (4) which extends below the sealing flange (3) and which is formed with a smaller radial extent than the sealing flange (3), and a handling portion (2) which extends above the sealing flange (3), a circumferential sealing projection (5) also being formed on the engagement portion (4) and protruding by a radial dimension (R1) with respect to an axial portion of the engagement portion (4) initially adjoining the sealing flange (3) from underneath and having a portion-radius (D1), wherein the circumferential sealing projection (5), at least with respect to its base portion, vertically overlaps a set-back region ($R_b$) which is formed on the sealing flange and is set back with respect to the boundary plane (E5), and wherein said set-back region ($R_b$) is an indented structure in the lower flange surface;

wherein material from which the closure stopper is made comprises at least one of a natural rubber, a rubber material, a soft plastics material, and a thermoplastic elastomer; and wherein said sealing flange (3) is elastically deformable; and wherein the circumferential sealing projection (5) is elastically deformable such that the sealing flange (3) of the closure stopper lies flat on the corresponding end face on a beaded lip of an ampoule in a combined state; and wherein the closure stopper (1) has a central recess (8) in the region of the engagement portion (4), and said central recess (8) is starting from the lower most end of the engagement portion (4) and, wherein the central recess (8) has a cylindrical wall portion in the region of the circumferential sealing projection (5); and wherein the closure stopper is formed rotationally symmetrically with respect to the center axis;

wherein the circumferential sealing projection is extending circumferentially without interruption in a plane perpendicular to the center axis; and wherein additionally to the lower central recess (8), an upper central recess (9) is provided for, wherein the central recess (8) extends until above the sealing flange (3), wherein the circumferential sealing projection (5) extends with its largest radius over the set-back region ($R_b$) and wherein a sealing flange radially outwards to the set-back region ($R_b$) runs with a lower delimiting plane coincident with the boundary plane (E5).

18. The closure stopper according to claim 17, wherein the central recess (8) extends upwardly until the region of the sealing flange (3) that the handling portion (2) has a further cavity (9), starting from an upper free end of the handling portion (2), and that the circumferential sealing projection (5) has a greater radial extension than the set-back region ($R_b$) combined with a lower straight boundary line of the flange.

19. A closure stopper (1) for pharmaceutical applications, namely the sealing closure of a container containing a pharmaceutical agent, having a sealing flange (3) for seating in a sealing manner on an end face of a closure mouth of the container, the sealing flange (3) having a lower sealing surface and a boundary plane (E5) which contacts an area protruding farthest downwardly of the sealing flange, and said contact is indeed a farthest downwardly area of the sealing flange, and extends perpendicularly with respect to a center axis of the closure stopper (1), an engagement portion (4) which extends below the sealing flange (3) and which is formed with a smaller radial extent than the sealing flange (3), and a handling portion (2) which extends above the sealing flange (3), a circumferential sealing projection (5) also being formed on the engagement portion (4) and protruding by a radial dimension (R1) with respect to an axial portion of the engagement portion (4) initially adjoining the sealing flange (3) from underneath and having a portion-radius (D1), wherein the circumferential sealing projection (5), at least with respect to its base portion, vertically overlaps a set-back region ($R_b$) which is formed on the sealing flange and is set back with respect to the boundary plane (E5), and wherein said set-back region ($R_b$) is given by an oblique extension, concerning a cross section, of a lower surface of the sealing flange;

wherein material from which the closure stopper is made comprises at least one of a natural rubber, a rubber material, a soft plastics material, and a thermoplastic elastomer; and wherein said sealing flange (3) is elastically deformable; and wherein the circumferential sealing projection (5) is elastically deformable such that the sealing flange (3) of the closure stopper lies flat on the corresponding end face on a beaded lip of an ampoule in a combined state; and wherein the closure stopper (1) has a central recess (8) in the region of the engagement portion (4), and said central recess (8) is starting from the lower most end of the engagement portion (4) and, wherein the central recess (8) has a cylindrical wall portion in the region of the circumferential sealing projection (5); and wherein the closure stopper is formed rotationally symmetrically with respect to the center axis;

wherein the circumferential sealing projection is extending circumferentially without interruption in a plane perpendicular to the center axis; and wherein additionally to the lower central recess (8), an upper central recess (9) is provided for, wherein the engagement portion (4) has a widening inner contour beneath the lower projection (21) and wherein the inner contour of the inner opening is also widening to the lower end of the closure; and wherein the central recess extends until above the sealing flange, wherein the central recess (8) has a conically tapering portion, and wherein the sliding projection (21) is provided for horizontally aligned with the conically tapering portion.

20. The closure stopper according to claim 19, wherein the central recess (8) extends upwardly until the region of the sealing flange (3) that the handling portion (2) has a further cavity (9), starting from an upper free end of the handling portion (2) and that the circumferential sealing projection (5) has a greater radial extension than the set-back region ($R_b$) combined with a lower straight boundary line of the flange.

21. The closure stopper according to claim 19, wherein groove base (N) of the set-back region ($R_b$) is formed as a straight line with regard to the contour line (L).

* * * * *